US006701638B1

(12) United States Patent
Polato

(10) Patent No.: US 6,701,638 B1
(45) Date of Patent: Mar. 9, 2004

(54) MACHINE FOR CONDITIONING LAMINAR FLEXIBLE PRODUCTS SUCH AS INDUSTRIAL HIDES AND SKINS

(75) Inventor: Antonio Polato, Mussolente (IT)

(73) Assignee: Officine di Cartigliano SpA, Cartigliano (IT)

( * ) Notice: Subject to any disclaimer, the term of this patent is extended or adjusted under 35 U.S.C. 154(b) by 0 days.

(21) Appl. No.: 10/130,436

(22) PCT Filed: Apr. 20, 2000

(86) PCT No.: PCT/IB00/00495

§ 371 (c)(1),
(2), (4) Date: May 15, 2002

(87) PCT Pub. No.: WO01/44517

PCT Pub. Date: Jun. 21, 2001

(30) Foreign Application Priority Data

Dec. 14, 1999 (KR) ..... 1999/57439

(51) Int. Cl.[7] ..... F26B 13/00

(52) U.S. Cl. ..... 34/618; 34/92; 34/619; 34/620

(58) Field of Search ..... 34/618, 92, 77, 34/75, 619, 620, 611

(56) References Cited

U.S. PATENT DOCUMENTS 3,309,733 A * 3/1967 Winstrom ..... 18/2.5
5,184,487 A * 2/1993 Corner ..... 69/19.1
5,970,754 A * 10/1999 Polato ..... 69/34
6,112,559 A * 9/2000 Zanette ..... 69/19.1
6,178,659 B1 * 1/2001 Corner et al. ..... 34/92

FOREIGN PATENT DOCUMENTS

| | | | |
|---|---|---|---|
| GB | 703391 A | | 2/1954 |
| GB | 2 043 860 A | * | 3/1979 |
| GB | 2163450 A | | 2/1986 |
| GB | 2 163 450 A | * | 2/1986 |
| WO | WO 9501540 | | 1/1995 |

* cited by examiner

*Primary Examiner*—Henry Bennett
*Assistant Examiner*—Camtu Nguyen
(74) *Attorney, Agent, or Firm*—R. Neil Sudol; Henry D. Coleman; William J. Sapone

(57) ABSTRACT

A machine for the conditioning of laminar flexible products such as industrial hides and skins, including at least one conditioning unit crossed by the products to be processed, blowers for blowing and extracting air directed toward products, and a series of air jets blowing simultaneously on both sides of the products under treatment in a transverse direction with respect to the advancement direction of the products. The products are caused to advance along a substantially horizontal plane by means of pairs of annular threads uniformly distributed across the useful width of the conditioning paths. The threads of each pair are placed on opposite sides and in contact with the products to support and transfer them along the path leaving their side surfaces substantially free. As an alternative, the advancement means are formed by pairs of endless belts in mutually facing relationship to firmly hold the products while permitting passage of blown air.

11 Claims, 5 Drawing Sheets

MACHINE FOR CONDITIONING LAMINAR FLEXIBLE PRODUCTS SUCH AS INDUSTRIAL HIDES AND SKINS

FIELD OF APPLICATION

The present invention generally applies to the field of treatment of laminar flexible products, such as hides and skins, and particularly relates to a machine for conditioning such products by means of suitably processed air.

BACKGROUND ART

It is known that some kinds of laminar flexible products, e.g. industrial hides, absorb remarkable quantities of water and exhibit high moisture content that is unacceptable in semifinished or finished products.

Accordingly, such products must undergo a drying process by means of suitable machines and industrial plants.

It may be that when the above products are subjected to the above drying process, they result excessively or unevenly dried, thus loosing the necessary flexibility and handiness and as such being exposed to the risk of damage during the subsequent treatments.

It is further known that several products, such as industrial hides, must be subjected to finishing process involving impregnation on both sides with proofing agents having given physical and chemical properties. In such cases, if the products are dried on one side only or on one side at a time, they may give rise to a true barrier on the dried side that prevents removal of residual moisture from the inside of the products, thus causing unpleasant smells for long periods.

It is therefore understood that in several industrial fields, such as in tanning industry, there must be provided proper means for "conditioning" the products, meaning with this term controlling and adjusting accurately the residual humidity of the products according to their nature and thickness, as well as to the particular requirements of the semifinished or finished items.

Machines and plants for drying laminar flexible products with high moisture contents are known, e.g. vacuum drying machines of discontinuous type.

Such machines are provided with heating plates on which the products to be dried such as hides are accurately laid and subjected to high vacuum.

The moisture released by the products in the form of vapours is condensed and removed in the form of water.

The hides which undergo the above drying treatment may still have a residual moisture content comprised between 30% to 50%, which content for given applications can be either too high or too low.

Other drying systems are known which are of a continuous type, e.g. the chain drying plants in which the products to be dried are hung on an endless chain that unwinds continuously in open air along a path extending through the working areas intended for other processes, in such a manner to save space and labour time. While such known plants have a relatively low cost, they have the inconvenience of an extremely low flexibility due to the fact that the treatment is the same for all products and thus cannot be adapted to the thickness and nature of the different products hung on the chain. Moreover, the products stand for a very long thereby involving a remarkable blocking of capital.

Tunnel plants are similarly known wherein the products are caused to advance in a conduit through which a moderate air current flows, previously processed by suitable conditioners or moisture absorbers to provide a repeated and fair drying. In these known conditioning plants, the moisture present in the product is not eliminated in a uniform and controlled manner. Moreover, the treatment of the products is excessively slow and it does not allow to adapt to the production requirements that are more and more differentiated in extremely short times. Even in this case, an excessive capital blockage is involved with evident economical disadvantage.

From GB-A-2163450 an apparatus is known for treating leathers comprising all the features contained in the preamble of claim 1. In this known apparatus, the leathers under treatment are dried with heated air and stretched with endless rope loops advancing in a horizontal direction in a heating chamber. Nozzles located on the opposite sides of the leathers blow the heated air, while the leathers are moved forward by endless rope loops. A disadvantage of this known apparatus is that each nozzle is so shaped to blow air in a rather localised area and therefore the products under treatment are dried in insufficiently uniform manner. Moreover, the endless rope loops of this known apparatus extend only in one horizontal branch and therefore the leathers are conveyed through the heating chamber for only one length with relatively reduced air-drying action.

From GB-A-703391 an apparatus is known for treating and conditioning products such as textile or paper making use of air, steam or other gaseous fluids blown by groups of nozzle members located on both sides of the conveyed products. In this known apparatus there is provided no means for supporting and advancing the products under treatment in the passage between the groups of nozzle members. Moreover, each nozzle member has a pair of elongated orifices at its bottom wall. Finally, the products under treatment are conveyed through only one horizontal length in which there are provided the air nozzle members.

DISCLOSURE OF THE INVENTION

A primary object of the present invention is to provide a machine for the conditioning of laminar flexible products, particularly industrial hides, which allows to accomplish a controlled and uniform drying of the products on both sides thereof while preventing retention of moisture internally thereof.

A further object is to conceive a conditioning machine of laminar flexible products showing high rate and effectiveness of the treatment to thereby prevent immobilisation of large quantities of products and consequently of money, so as to obtain substantially planar and defect-free products.

A further object of the invention is to provide a conditioning machine having characteristics of high flexibility allowing to easily and promptly adjust the process parameters according to the products under treatment.

Another object is to provide a conditioning machine with relatively simple and compact structure so as to require a limited labour skill.

A further object is to provide a machine having a conditioning part as long as possible in a restricted space.

Still another object is to conceive a machine for the conditioning of leathers and similar products having a modular structure that is capable to adapt to particular requirements of bulk and of productivity in the room in which it is located.

These and other objects are achieved with a machine for the conditioning of leathers and similar laminar products in accordance with claim 1, which comprises at least one modular conditioning unit having an outer case with an inlet section for the products to be treated and an outlet section for the already treated products, means for the advancement of the products in a longitudinal direction between said inlet and outlet sections along a conditioning path, said advancement means comprising endless members adapted to face the opposite side of said products with respect to an advancement plane to firmly support and advance them along said conditioning path, means for circulating air within said conditioning unit, said air circulation means comprising two series of nozzles located on opposite sides of said advancement plane at regularly longitudinally spaced distance with respect to each other, said nozzles being provided with respective outlet ports for blowing air jets transversely of said advancement plane simultaneously on both sides of the products, characterised in that said outlet ports comprise for each nozzle a single elongated slit extending transversely with respect to said advancement direction, said endless members comprising a plurality of adjacent and straight lengths which are reciprocally superimposed and connected at one end thereof by reversing portions to define a substantially sinusoidal path, said series of nozzles being regularly distributed over all of said adjacent straight lengths.

Thanks to this arrangement, the products are subjected to a substantially uniform air blowing action while they are maintained in a substantially planar and even configuration with an extremely reduced shrinkage, thus allowing a quicker and more effective conditioning of the products.

In a preferred embodiment, each of the elongated slits has a substantially constant width and extends over almost the entire width of the conditioning unit.

Advantageously, the outlet ports of the nozzles may be arranged in substantially facing relationship, respectively in offset relationship with respect to the longitudinal direction.

The nozzles may comprise lateral walls converging towards said outlet ports and joined by a bottom wall substantially parallel to said advancement plane, where the outlet elongated slits are formed.

BRIEF DESCRIPTION OF DRAWINGS

Further features and advantages of the invention will become more apparent in the light of the following description of preferred but not exclusive embodiments of a machine for conditioning leathers and similar laminar flexible products, furnished hereinafter by way of non limiting example with the aid of the accompanying drawings, wherein.

DETAILED DESCRIPTION OF PREFERRED EMBODIMENTS

Figure 1:
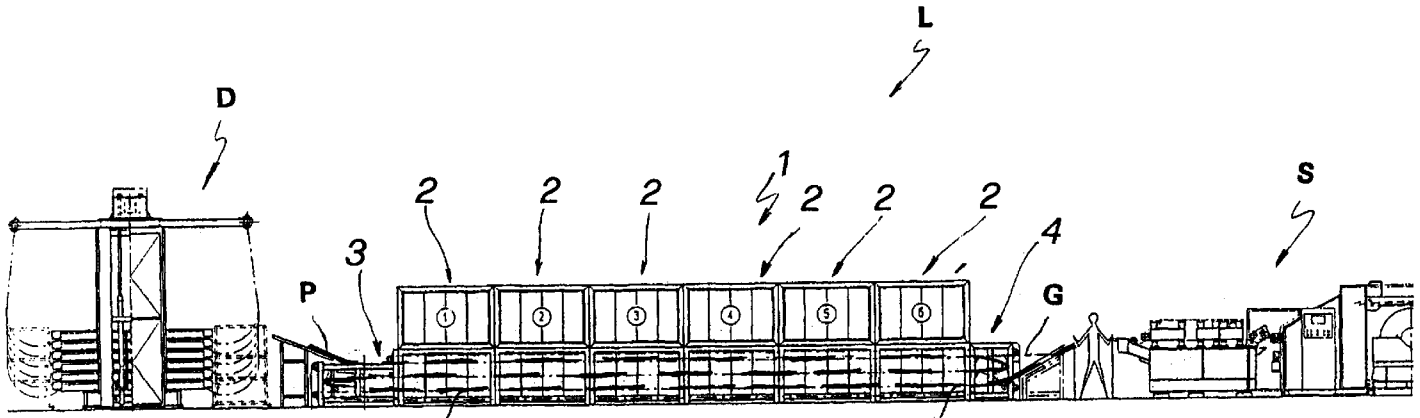
FIG. 1 shows a lateral general view of a plant for the treatment of hides incorporating a first embodiment of a conditioning machine according to the invention.
Figure 9:
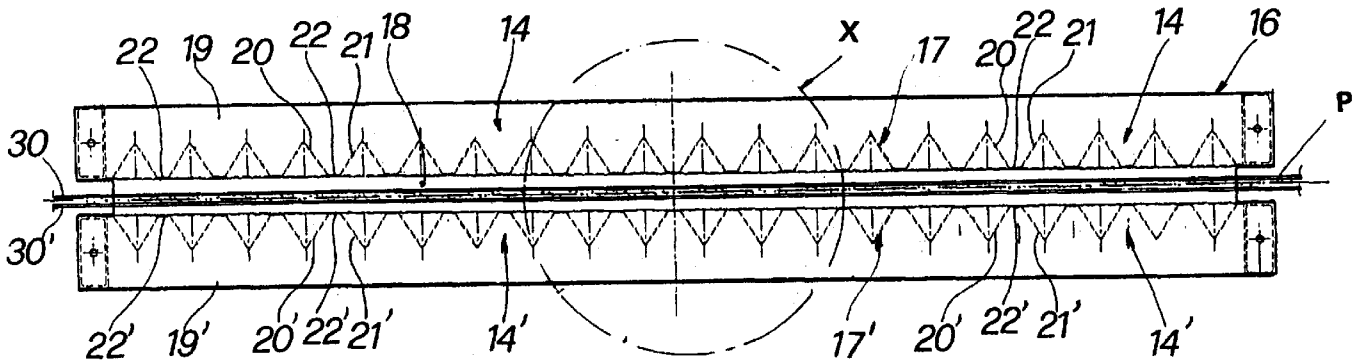
FIG. 9 shows a sectional view in enlarged scale of a detail of the machine according to the invention.

FIG. 1 shows a plant L for the treatment of laminar flexible products, e.g. industrial hides P, in which a conditioning machine according to the invention, generally indicated with the reference numeral 1, is provided.

Plant L includes, upstream of the conditioning machine 1 according to the invention, a per se known vacuum drying machine D with multiple heating plates in which hides are subjected to drying until they possess a residual relative humidity comprised e.g. between 20% and 40%. Downstream of the drying machine D, the hides P undergo a conditioning process, this term meaning a process for controlling and adjusting their relative moisture content up to a residual humidity level comprised e.g. between 10% and 20%. Finally the hides are forwarded to a perching machine S of a known type, to soften them and increase their footing.

The conditioning machine 1 can be obviously applied even separately or between machines and treatment steps different from those shown in FIG. 1 without departing from the scope of the invention.

Further, a conditioning machine shall be used even for increasing the moisture content, thereby conferring to the products a handy touch and a quality partly lost during the preceding drying phase.

In addition, the number of conditioning units may be established in accordance with any requirement stated by the user and by the type of products to be treated.

The machine 1 schematically depicted in FIG. 1 is comprised of six modular units 2 which are substantially identical and arranged in line one after the other, wherein the products P are advanced along a conditioning path extending in a substantially longitudinal direction A from an inlet section 3 for the products to be treated to an outlet section for the already treated products.

During advancement of the products P, these latter are maintained in a substantially extended condition on a substantially horizontal plane G, although such plane may be inclined or vertically directed without falling outside the scope of the invention.

FIGS. 2 to 10 show a simplified embodiment of the conditioning machine according to the invention, which machine is constituted by only two modular units arranged one after the other and similarly provided with an inlet section and an outlet section 4 for products P.

Each unit 2 is essentially formed by a box-like case 5, e.g., metal plate, and comprises lateral, upper and lower walls which are substantially planar. The inner space defined by the above wall has predetermined width W and length T and is provided with a partition wall 6 defining a lower portion 7 and an upper portion 8.

The lower portion 7 defines a space for the passage of products P using suitable advancement means and means for processing thereof with suitable air blowing means.

Figure 4:
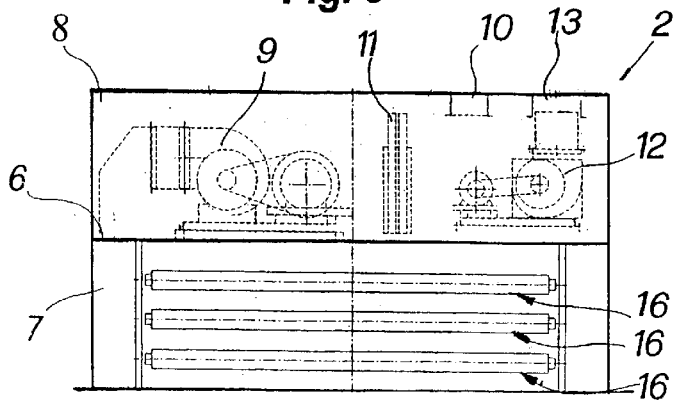
FIG. 4 shows a front view of the machine of FIG. 2 with some parts viewed in transparency.
Figure 6:
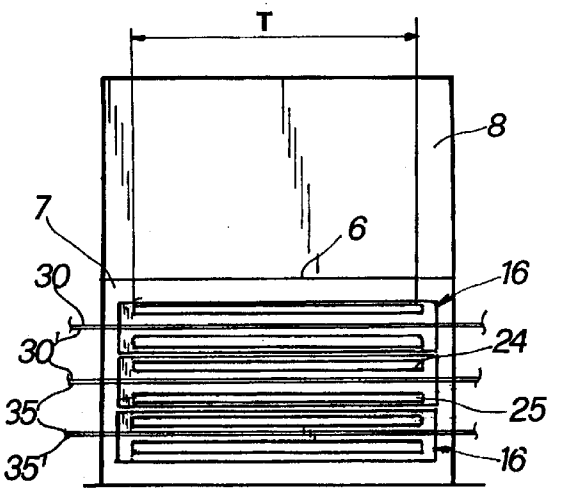
FIG. 6 shows a partially section view of the unit of FIG. 5 taken along a vertical plane VI—VI.
Figure 8:
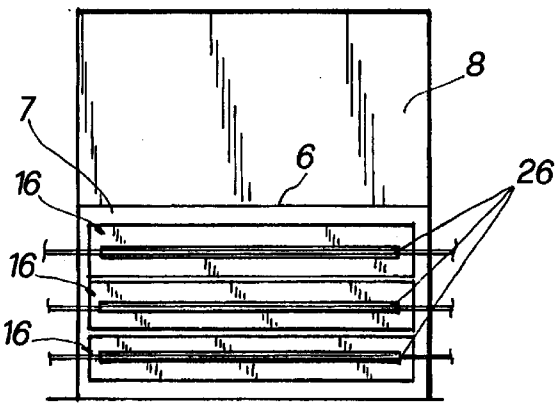
FIG. 8 shows a sectional view taken along the plane VIII—VIII of the machine of FIG. 5.
Figure 5:
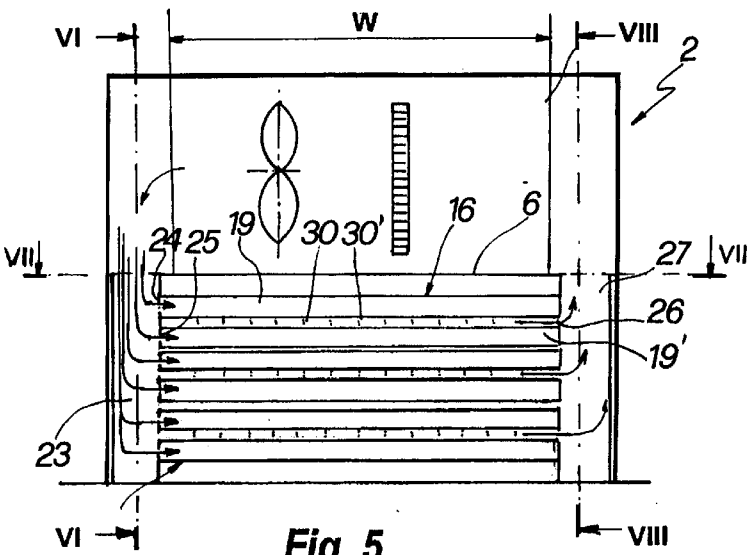
FIG. 5 shows a schematic view of a modular unit for the machine according to the invention, partially sectioned along a transverse vertical plane V—V.
Figure 7:
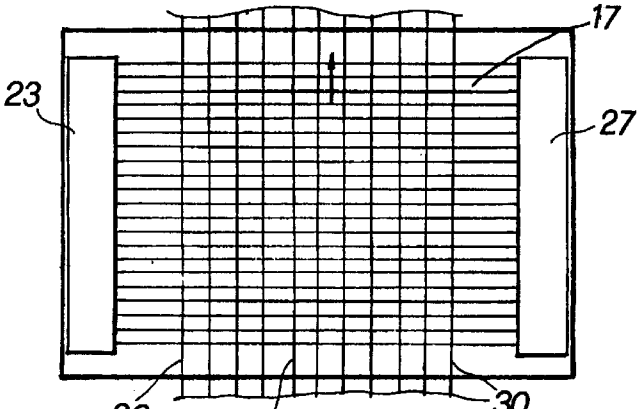
FIG. 7 shows a sectional view taken along the plane VII—VII of the machine of FIG. 5.
Figure 10:
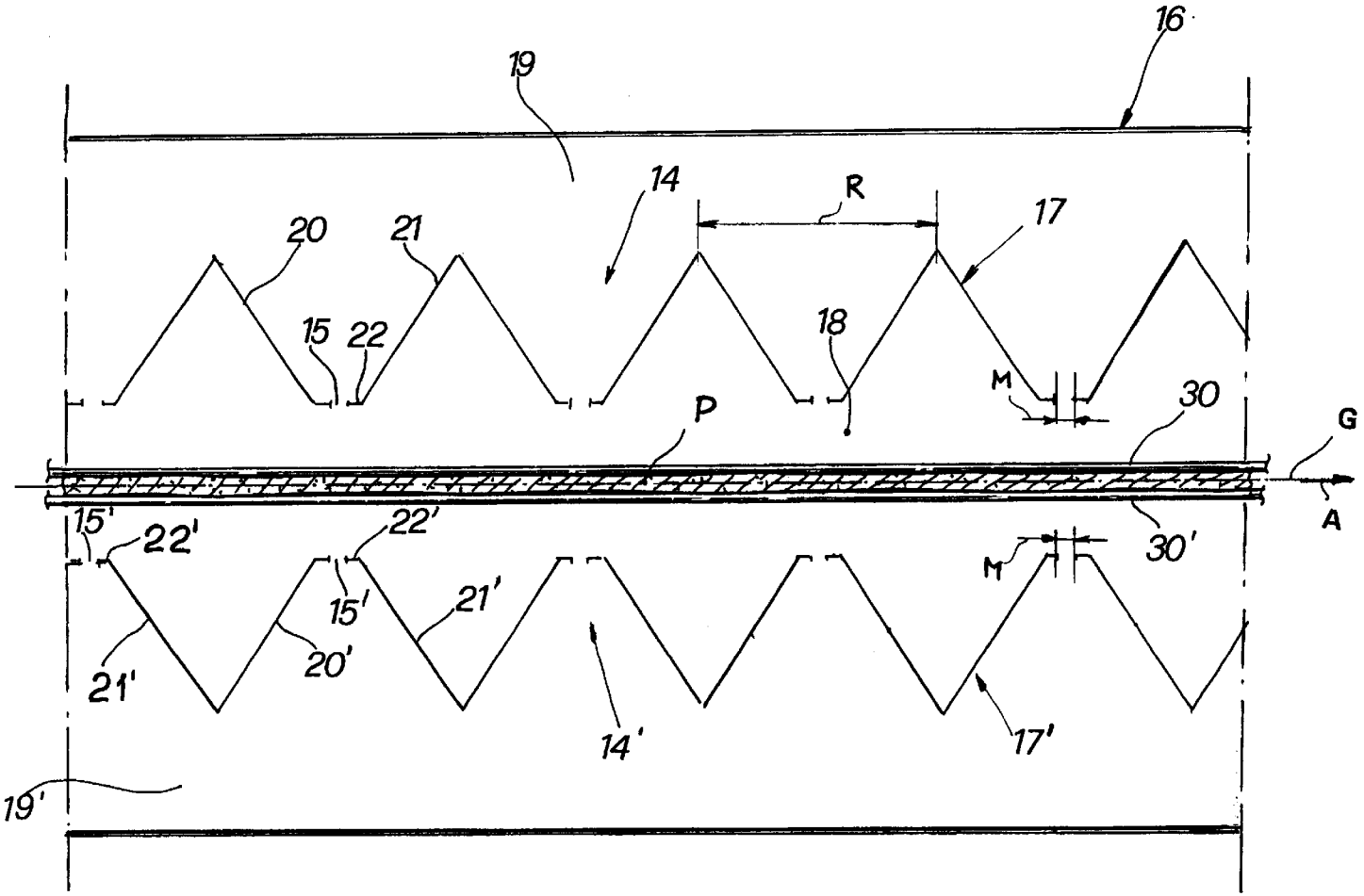
FIG. 10 shows a detailed view in further enlarged scale of the detail of FIG. 9.

As more clearly illustrated in FIG. 4, the upper portion 8 accommodates part of the air circulation means comprising one or more blower 9 for the circulation of air introduced from the outside through an opening 10 and for the passage thereof through a heat exchanger 11 before entering the lower portion 7.

The air which has accomplished its conditioning function is drawn from the lower portion 7 and discharged outside by means of an exhaust blower 12 through an outlet opening 13.

According to the invention, the circulation means comprise jets of air simultaneously directed on both sides of products P during advancement thereof along the conditioning path.

More particularly the air jets are generated by a series of nozzles 14, 14' having outlet ports 15, 15' arranged on opposite sides with respect to the lying plane of the products.

Preferably the blown air jets are oriented transversely with respect to the advancement direction A of the products during the conditioning path.

In addition, ports 15, 15' are arranged in mutually facing relationship. As an alternative, ports 15, 15' may be longitudinally offset thereby generally obtaining the same resulting effects.

A preferred embodiment of nozzles 14, 14' will be described hereinafter, it being obvious that alternative shapes may be equally employed provided that they fall within the same inventive concept.

In particular, one or more blowing chambers 16 are defined in the lower portion 7, which chambers have approximately a prism-like or cubic shape similar to horizontal drawers.

Advantageously, each chamber 16 may be internally provided with a pair of corrugated plates 17, 17' with fixed or variable step length R, which plates are placed in substantially facing relationship and symmetrically transversely spanned with respect to an intermediate plane G that defines the plane in which the products P are advanced. The corrugated plates 17, 17' subdivide chamber 16 in a central hollow space 18, an upper hollow space 19 and a lower hollow space 19'.

Preferably, the corrugations of plates 17, 17' extend in a substantially transverse direction with respect to the advancement direction A of the products. Such corrugations are uniformly longitudinally spaced-apart to define respective walls 20, 21, 20', 21' slanted with respect to the lying plane G and respective bottom walls 22, 22' which are substantially parallel to the plane G.

Such bottom walls 22, 22' are provided with slits having a substantially uniform thickness M to define the outlet ports 15, 15'. Accordingly, the nozzles 14, 14' will be generally constituted by the lateral walls 20, 21, 20', 21' and by the slits or outlet ports 15, 15' formed on the bottom walls 22, 22'.

Suitably, the outlet ports 15, 15' extend approximately over the entire width W of the conditioning unit 2. Moreover the series of nozzles 14, 14' are arranged at a regular distance from each other lenghtwise with respect to the longitudinal extension of unit 2.

The air blown by blower 9 and heated by heat exchangers 11 is conveyed to a lateral manifold 23 which is common to more blowing chambers 16 and is distributed to each hollow space 19, 19' through corresponding apertures 24, 25.

The air is than conveyed to nozzles 14, 14' and blown through outlet ports 15, 15' towards the products P which are advanced along the hollow space 18 while being maintained in extended condition of the plane G.

Optionally, adjustment valves or shutters may be provided in correspondence of each inlet aperture to adjust the air flow rate in each blowing chamber 16 so as to adapt the conditioning state of the products along the path according to the desired requirements.

The exhaust air is evacuated from the hollow space 18 through a single central aperture 26 provided in each chamber 16 and passes through a lateral collecting manifold common to all chambers 16. In order to maintain a controlled humidity level, part of the air passing through the machine can be drawn from manifold 27 through exhaust blower 12 and discharged to the outside through aperture 13. Fresh air is simultaneously introduced by closing aperture 10.

Preferably, the nozzles are so sized to accelerate the outlet velocity of air up to a value of e.g. 10 m/s.

Each chamber 16 constitutes a step of the conditioning process for the hides and the number of steps of the machine depends on various factors, e.g. type and nature of leathers, thickness and initial moisture content. Hence, the number of blowing chambers 16 determines the working capacity of the machine.

Figure 2:
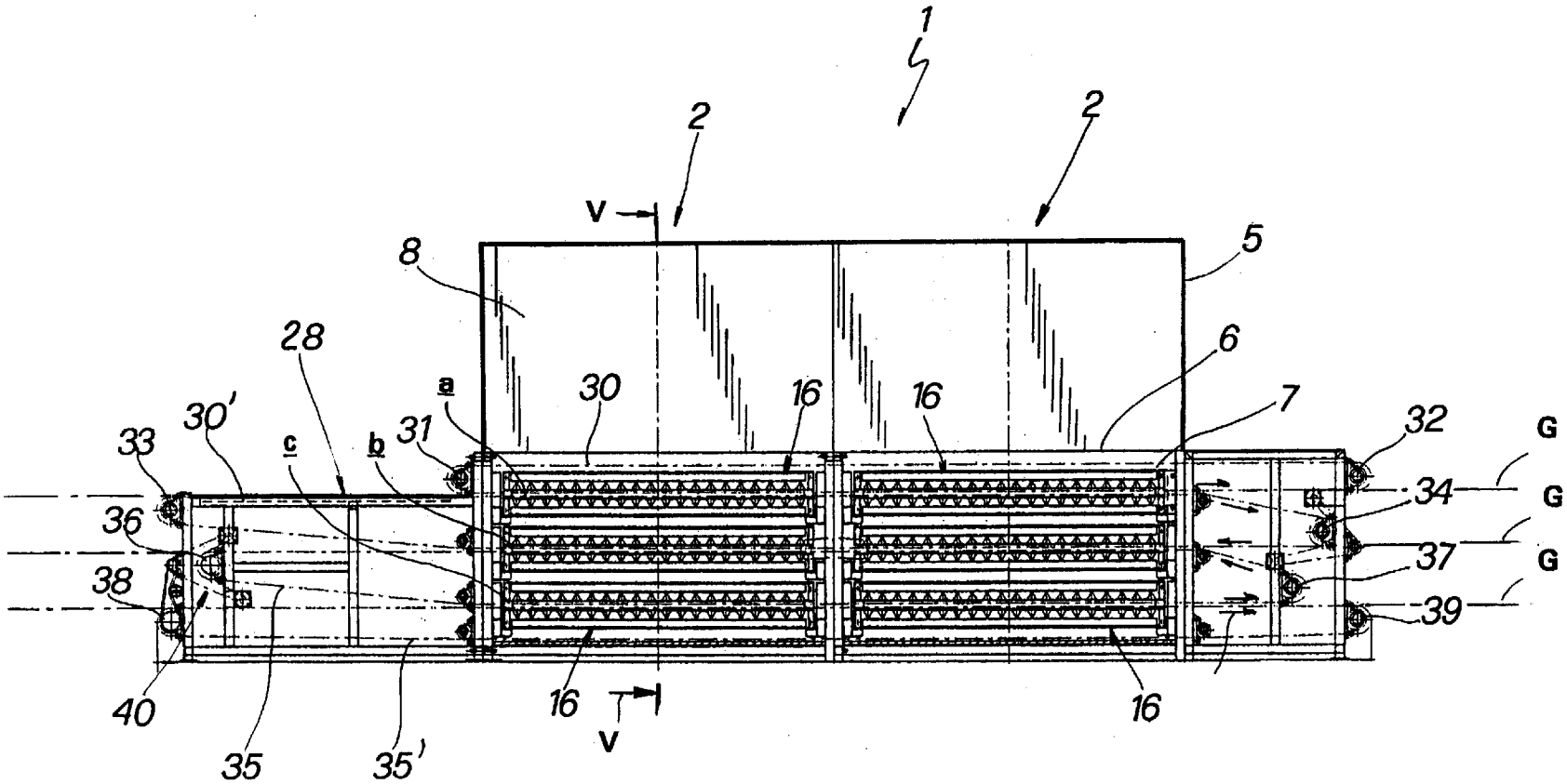
FIG. 2 shows a lateral view partly sectioned along a vertical longitudinal plane of a second embodiment of a conditioning machine according to the invention.
Figure 3:
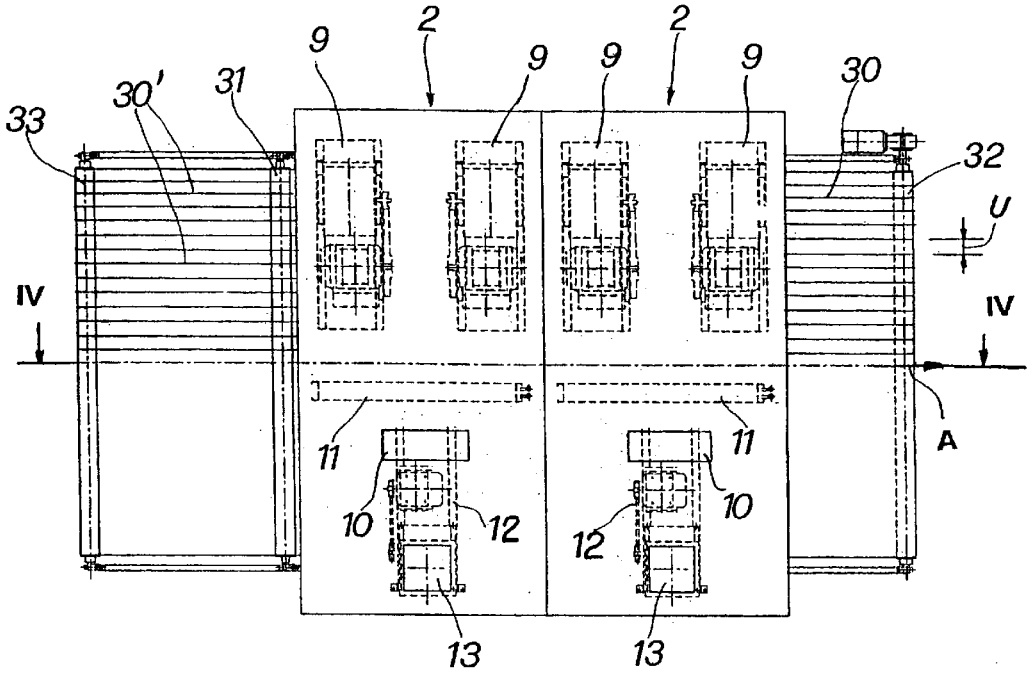
FIG. 3 shows a plan view of the machine of FIG. 2 with some parts viewed in transparency.

In the embodiments depicted in FIGS. 2, 3 and 4 each of the conditioning units 2 presents three blowing chambers 16 which are mutually superimposed.

In a preferred embodiment the advancement means, generally indicated with reference numeral 28, are formed by pairs of annular threads 30, 30' arranged in side by side relationship in transverse direction with steps of length U.

The annular threads 30, 30' are wound on end rollers 31, 32, 33, 34 in such a manner to run parallel within the hollow space 18 of chamber 16 along a substantially straight and horizontal length a longer than twice the longitudinal dimension T of each modular unit 2, thereby firmly holding the leathers P in the plane G Thus, the pairs of adjacent threads 30, 30' will define a first forward length a directed along the arrow F. A second series of thread pairs 35, 35' similar to and placed below the preceding ones are analogously wound of respective end rollers 36, 37, 38, 39 and define a backward length b with respect to the previous series of thread pairs 30, 30' directed along arrow F'. A second forward length c extends between the previous lengths a and b along the direction of arrow F. Thus, the pairs of threads 30, 30', 35, 35' placed side by side, generally define a conditioning path having a sinusoidal or labyrinth shaped configuration comprising straight lengths a, b, c.

An overturning assembly 40 may be provided proximally to the end rollers to provide automatic reversal of products P between each length a, b, c and the subsequent one to prevent manual intervention of workers.

The pairs of threads are arranged in side by side relationship and are uniformly distributed on the whole useful width W of unit 2 to maintain the products P firmly supported therebetween. Thanks to the reduced thickness of the threads, the leathers P will be almost fully faced to the air flow thereby allowing an optimum conditioning on both sides thereof.

Threads 30, 30', 35, 35' may be made of synthetic, high-strength materials with low coefficient of elasticity, e.g. Perlon®.

In an alternative embodiment, not depicted in the drawings, the advancement means may be constituted by pairs of endless belts, mutually faced so as to firmly trap therebetween the products P to be conditioned, thereby allowing the passage of air blown by the nozzles.

The order with which the products P cross chambers 16 is predetermined at the project stage of the machine 1 and may also differ substantially from the above described sequence without departing from the scope of the invention. By way of example, the number of lengths a, b, c may also be different, e.g. an even number, and consequently the inlet section 3 and the outlet section 4 may be placed at the same end of the machine instead of at opposite ends thereof.

In view of such an arrangement with blowing chambers and superimposed lengths, the machine may transfer the products along a longer conditioning path with a smaller longitudinal extension.

Thus, the machine will show an outstanding compactness with the same length of the conditioning path thus involving a notable reduction of labour in spite of the same output of treated products.

Moreover, thanks to the simultaneous action of the air jets at very high velocity on both sides of the products, these latter will exhibit after treatment thereof a substantially planar and even surface as well as an extremely reduced shrinkage.

The conditioning machine will be obviously provided with means for varying and adjusting the flow rate, temperature and humidity of the conditioning air, comprising e.g. valves, heaters and water and vapours jets.

Moreover, the conditioning machine may be provided with a per se known central control unit of electronic type which a digital interface. Such central control unit is preferably connected with suitable sensing means and with the above adjusting means to control the flow rate, temperature and humidity of the air evolving along the path.

In addition, a system for recirculation of air may be provided to redirect the controlled air instead of discharging it into the outside environment in order to save energy.

What is claimed is:

1. Machine for the conditioning of laminar flexible products, such as industrial hides and skins, comprising:

at least one modular conditioning unit having an outer case with an inlet section for the products to be treated and an outlet section for the already treated products;

means for the advancement of the products in a longitudinal direction between said inlet and outlet sections along a conditioning path, said advancement means comprising endless members adapted to face the opposite side of said products with respect to an advancement plane to firmly support and advance them along said conditioning path;

means for circulating air within said conditioning unit, said air circulation means comprising two series of nozzles located on opposite sides of said advancement plane at regularly longitudinally spaced distance with respect to each other, said nozzles being provided with respective outlet ports for blowing air jets transversely of said advancement plane simultaneously on both sides of the products;

wherein said outlet ports comprise for each nozzle a single elongated slit extending transversely with respect to said advancement direction, said endless members comprising a plurality of adjacent and straight lengths which are reciprocally superimposed and connected at one end thereof by reversing portions to define a substantially sinusoidal path, said series of nozzles being regularly distributed over all of said adjacent straight lengths to exert on the products a substantially uniform air blowing action while keeping them in a substantially planar and even configuration with an extremely reduced shrinkage, said nozzles comprising lateral walls converging towards said outlet ports and joined by a bottom wall substantially parallel to said advancement plane, said outlet elongated slits being formed in said bottom wall, each of said elongated slits extending over almost the entire width of said conditioning unit.

2. Machine according to claim 1, wherein each of said elongated slits has a substantially constant width over almost the entire width of said conditioning unit.

3. Machine according to claim 1, wherein said outlet ports are arranged in substantially facing relationship, respectively in offset relationship with respect to said longitudinal direction.

4. Machine according to claim 1, wherein it comprises a plurality of modular conditioning units which are reciprocally assembled in line one after the other, said advancement means being located within said conditioning units to extend between said inlet section and said outlet section.

5. Machine according to claim 1, wherein said endless members comprise a plurality of independent threads arranged on opposite sides with respect to said advancement plane.

6. Machine according to claim 1, wherein said endless members are pairs of endless belts of meshed tissue which are mutually faced to firmly hold said products during advancement thereof while permitting passage of air blown on the products.

7. Machine according to claim 1, wherein each conditioning unit comprises at least one blowing chamber for the distribution of air to said nozzles.

8. Machine according to claim 7, wherein said air circulation means further comprise at least one first blower for the circulating the air within said blowing chamber, heating means and means for adjusting the air humidity, and optionally a second exhaust blower for drawing the exhaust air from said blowing chamber.

9. Machine according to claim 8, wherein said circulation means further comprise means for sensing and adjusting the flow rate, temperature and humidity of the blown air, a central control unit connected to said sensing and adjustment means for controlling the flow rate, temperature and humidity of the blown air.

10. Machine for the conditioning of laminar flexible products, such as industrial hides and skins, comprising:

at least one modular conditioning unit having an outer case with an inlet section for the products to be treated and an outlet section for the already treated products;

means for the advancement of the products in a longitudinal direction between said inlet and outlet sections along a conditioning path, said advancement means comprising endless members adapted to face the opposite side of said products with respect to an advancement plane to firmly support and advance them along said conditioning path;

means for circulating air within said conditioning unit, said air circulation means comprising two series of nozzles located on opposite sides of said advancement plane at regularly longitudinally spaced distance with respect to each other, said nozzles being provided with respective outlet ports for blowing air jets transversely of said advancement plane simultaneously on both sides of the products;

said outlet ports comprising for each nozzle a single elongated slit extending transversely with respect to said advancement direction, said endless members comprising a plurality of adjacent and straight lengths which are reciprocally superimposed and connected at one end thereof by reversing portions to define a substantially sinusoidal path, said series of nozzles being regularly distributed over all of said adjacent straight lengths to exert on the products a substantially uniform air blowing action while keeping them in a substantially planar and even configuration with an extremely reduced shrinkage, each conditioning unit comprising at least one blowing chamber for the distribution of air to said nozzles, said air circulation means further comprising at least one first blower for the circulating the air within said blowing chamber, heating means and means for adjusting the air humidity, and optionally a second exhaust blower for drawing the exhaust air from said blowing chamber, said circulation means further comprising means for sensing and adjusting the flow rate, temperature and humidity of the blown air, a central control unit connected to said sensing and adjustment means for controlling the flow rate, temperature and humidity of the blown air.

11. Machine for the conditioning of laminar flexible products, such as industrial hides and skins, comprising:

at least one modular conditioning unit having an outer case with an inlet section for the products to be treated and an outlet section for the already treated products;

means for the advancement of the products in a longitudinal direction between said inlet and outlet sections along a conditioning path, said advancement means comprising endless members adapted to face the opposite side of said products with respect to an advancement plane to firmly support and advance them along said conditioning path;

means for circulating air within said conditioning unit, said air circulation means comprising two series of nozzles located on opposite sides of said advancement plane at regularly longitudinally spaced distance with respect to each other, said nozzles being provided with respective outlet ports for blowing air jets transversely of said advancement plane simultaneously on both sides of the products;

wherein said outlet ports comprise for each nozzle a single elongated slit extending transversely with respect to said advancement direction, said endless members comprising a plurality of adjacent and straight lengths which are reciprocally superimposed and connected at one end thereof by reversing portions to define a substantially sinusoidal path, said series of nozzles being regularly distributed over all of said adjacent straight lengths to exert on the products a substantially uniform air blowing action while keeping them in a substantially planar and even configuration with an extremely reduced shrinkage, said endless members being pairs of endless belts of meshed tissue which are mutually faced to firmly hold said products during advancement thereof while permitting passage of air blown on the products.

* * * * *